US011484144B2

(12) United States Patent
Tan et al.

(10) Patent No.: US 11,484,144 B2
(45) Date of Patent: Nov. 1, 2022

(54) MOUNTING ROD ASSEMBLY FOR INSTALLING A CURTAIN

(71) Applicant: NINGBO LIYANG NEW MATERIAL COMPANY LIMITED, Ningbo (CN)

(72) Inventors: Baoguo Tan, Ningbo (CN); Chun Jiang, Ningbo (CN)

( * ) Notice: Subject to any disclaimer, the term of this patent is extended or adjusted under 35 U.S.C. 154(b) by 192 days.

(21) Appl. No.: 17/010,768

(22) Filed: Sep. 2, 2020

(65) Prior Publication Data

US 2021/0137295 A1 May 13, 2021

(30) Foreign Application Priority Data

Nov. 7, 2019 (CN) ..... 201911081839.1

(51) Int. Cl.
*A47H 1/022* (2006.01)
*A47H 1/08* (2006.01)
*A47H 1/02* (2006.01)

(52) U.S. Cl.
CPC ..... *A47H 1/022* (2013.01); *A47H 1/08* (2013.01); *A47H 2001/0215* (2013.01)

(58) Field of Classification Search
CPC .. A47H 1/022; A47H 2001/0215; A47H 1/04; A47H 1/08; A47H 2001/006; A47H 2001/003; A47H 1/02; A47H 2/02; A47B 61/02; Y10T 16/35; Y10T 16/354; Y10T 16/379; Y10T 16/3797; Y10T 403/32426; Y10T 403/32434; Y10T 403/32442; Y10T 403/32457
USPC ..... 211/105.3–105.6; 16/94 R; 248/261, 248/263, 211, 257, 259, 260, 265, 269, 248/270, 271, 272, 354.7; 403/104–107
See application file for complete search history.

(56) References Cited

U.S. PATENT DOCUMENTS 591,112 A * 10/1897 Doty et al. ..... E06B 9/50 248/272
624,482 A * 5/1899 Halton ..... E06B 9/50 248/909
726,244 A * 4/1903 Bell ..... A47H 1/13 248/260
849,377 A * 4/1907 Doehler, Sr. ..... E06B 9/50 248/272
902,744 A * 11/1908 Koretz ..... A47H 1/13 248/260
916,265 A * 3/1909 Bryant et al. ..... E06B 9/50 248/272
923,630 A * 6/1909 Davie ..... E06B 9/50 248/272

(Continued)

*Primary Examiner* — Jennifer E. Novosad
(74) *Attorney, Agent, or Firm* — W&K IP

(57) ABSTRACT

A mounting rod assembly for installing a curtain has a main rod and a telescopic rod; one end of the telescopic rod stretches into the main rod and can slide along the length direction of the main rod, and the main rod is provided with a locking member for stopping the sliding of the telescopic rod; through the cooperation of the telescopic rod and the main rod, the entire mounting rod assembly can be fitted to the window frames of various sizes during installation. The installation length is adjusted by adjusting the length of the telescopic rod extending out of the main rod, and then locking and positioning the telescopic rod with the locking member, which makes the curtain more applicable and the installation more flexible.

5 Claims, 3 Drawing Sheets

(56) References Cited

U.S. PATENT DOCUMENTS 1,006,183 A * 10/1911 Davie ..... E06B 9/50 248/272
1,017,574 A * 2/1912 Marquis ..... A47H 1/13 248/260
1,032,265 A * 7/1912 Anderson ..... A47H 15/04 211/105.3
1,079,641 A * 11/1913 Drake ..... E06B 9/50 248/272
1,082,129 A * 12/1913 McCabe ..... B66B 13/08 16/105
1,154,902 A * 9/1915 Wizsolyi ..... A47H 1/13 248/260
1,163,840 A * 12/1915 Meyer ..... A47H 1/13 248/260
1,225,469 A * 5/1917 Mistrik ..... A47H 1/13 248/260
1,228,898 A * 6/1917 Frank ..... F16B 12/58 403/105
1,239,845 A * 9/1917 Tibbetts et al. ..... A47H 1/13 248/260
1,253,486 A * 1/1918 Hammer ..... A47H 1/022 211/105.4
1,257,016 A * 2/1918 Nylund ..... A47H 1/13 248/260
1,272,848 A * 7/1918 Plack ..... E06B 9/50 248/272
1,353,695 A * 9/1920 Zebrowski ..... E06B 9/50 248/272
1,389,415 A * 8/1921 Zebrowski ..... E06B 9/50 248/260
1,407,877 A * 2/1922 Mott ..... E06B 9/50 248/272
1,409,032 A * 3/1922 Salata ..... A47H 1/13 248/252
1,476,164 A * 12/1923 Manahan ..... A47H 1/13 248/252
1,501,843 A * 7/1924 Durnell ..... A47H 1/13 248/252
1,579,637 A * 4/1926 Brent ..... E06B 9/50 248/272
1,604,157 A * 10/1926 Fields ..... A47H 1/13 248/260
1,623,274 A * 4/1927 Robinson ..... A47H 1/122 248/260
1,777,697 A * 10/1930 Lawrence ..... E06B 9/50 248/272
1,802,303 A * 4/1931 Zalewski ..... A47H 1/08 248/261
1,805,995 A * 5/1931 Palladino ..... E06B 9/50 248/260
1,857,991 A * 5/1932 Vogt ..... A47H 1/08 211/105.6
2,293,168 A * 8/1942 Pirone ..... A47H 1/022 211/105.4
2,323,112 A * 6/1943 Birnie ..... A47H 1/022 160/385
2,385,608 A * 9/1945 Castagna ..... A47H 1/022 211/105.3
2,563,570 A * 8/1951 Williams ..... A47C 21/00 211/184
2,706,632 A * 4/1955 Chandler ..... A63B 21/154 5/503.1
2,895,704 A * 7/1959 Urbain ..... E04F 15/00 52/27
3,124,253 A * 3/1964 Petrich ..... A47G 25/746 211/94.01
3,589,757 A * 6/1971 Mooney ..... F16M 11/32 248/188.5
4,114,233 A * 9/1978 Hamilton ..... A47H 1/04 D6/575
4,270,720 A * 6/1981 Fukuchi ..... A47H 1/142 248/257
4,897,958 A * 2/1990 Brydges ..... A47H 27/00 47/68
5,094,576 A * 3/1992 Fredelius ..... B60P 7/15 410/151
5,149,032 A * 9/1992 Jones ..... A47G 23/0225 248/316.4
5,159,968 A * 11/1992 Lawson ..... A47H 1/04 160/348
5,295,648 A * 3/1994 Hames ..... G06F 1/16 248/924
5,421,551 A * 6/1995 LeClaire ..... A47H 1/122 248/265
5,433,551 A * 7/1995 Gordon ..... F16B 7/149 403/368
5,647,578 A * 7/1997 Bivens ..... F16F 9/3221 267/221
5,791,394 A * 8/1998 Huang ..... A47H 5/032 16/95 D
5,813,647 A * 9/1998 Chen ..... B60P 7/15 410/151
6,126,302 A * 10/2000 Corn ..... B60N 3/00 362/135
6,227,513 B1 * 5/2001 Richard ..... F16M 11/041 248/354.7
6,347,817 B1 * 2/2002 Chou ..... B60P 7/15 292/DIG. 60
6,467,739 B1 * 10/2002 Jou ..... A47B 9/14 248/188.5
6,571,426 B2 * 6/2003 Chen ..... A47G 25/0692 211/105.6
6,685,149 B1 * 2/2004 Chang ..... G03B 23/00 353/70
6,691,983 B2 * 2/2004 Arzouman ..... B66F 13/00 248/354.7
6,823,997 B2 * 11/2004 Linden ..... A47F 1/12 211/59.3
6,905,035 B2 * 6/2005 McKinney, Jr. ..... A47G 25/746 211/85.3
7,331,567 B2 * 2/2008 Li ..... F16B 7/14 410/151
7,703,501 B2 * 4/2010 ter Braak ..... A47H 5/0325 160/346
8,128,306 B2 * 3/2012 Gorza ..... F16B 7/1454 403/109.5
8,162,280 B2 * 4/2012 Yu ..... F16M 11/06 248/292.12
8,833,720 B2 * 9/2014 Liu ..... A47B 65/15 248/346.07
10,413,090 B2 * 9/2019 Hardy ..... A47F 3/14
10,743,698 B1 * 8/2020 Chen ..... A47H 15/04
10,988,985 B2 * 4/2021 Yoo ..... E06C 1/18
2003/0221282 A1 * 12/2003 ter Braak ..... A47H 5/0325 16/87.4 R
2005/0193625 A1 * 9/2005 Rosser ..... A47H 27/00 47/68
2006/0081746 A1 * 4/2006 Shevick ..... A47H 1/18 248/254
2010/0224332 A1 * 9/2010 Hibshman ..... A47H 1/08 160/405
2014/0000820 A1 * 1/2014 Diamond ..... E06B 9/42 160/368.1
2015/0173548 A1 * 6/2015 Lin ..... E06B 9/262 248/251
2016/0374496 A1 * 12/2016 Marcinik ..... A47H 15/02 160/331
2017/0020322 A1 * 1/2017 Whittemore ..... E04G 25/00
2021/0137295 A1 * 5/2021 Tan ..... A47H 1/08
2022/0087466 A1 * 3/2022 Jiang ..... A47H 5/0325

* cited by examiner

MOUNTING ROD ASSEMBLY FOR INSTALLING A CURTAIN

CROSS-REFERENCE TO RELATED APPLICATIONS

This application claims priority to Chinese Patent Application No. 201911081839.1 with a filing date of Nov. 7, 2019. The content of the aforementioned applications, including any intervening amendments thereto, are incorporated herein by reference.

TECHNICAL FIELD

The present disclosure relates to the technical field of curtain installation, in particular to a mounting rod assembly for installing a curtain.

BACKGROUND

Curtains are widely used at homes, offices and other places alike, mainly for adjusting the indoor light. Among all the curtains, roller blinds, venetian blinds, and honeycomb blinds are more commonly used. When a curtain is to be installed, it is generally necessary to determine the size of the window frame first, and then select the suitable curtain for installation. However, if the size of the curtain does not match with the size of the window frame, one might need to select and purchase a new curtain since the size of the curtain is usually determined after production and assembly. It is difficult for one curtain to match with window frames of various sizes, and during the purchase of a curtain, the size of the curtain may be too large or too small and the curtain may need to be replaced or reselected, due to poor flexibility in installation.

SUMMARY

One objective of the present disclosure is to overcome the shortcomings of the prior arts by providing a mounting rod assembly for installing a curtain, with adjustable installation length which adapts to window frames of various sizes and ensures high flexibility in installation.

The technical solution of the present disclosure is as follows: a mounting rod assembly for installing a curtain comprising a main rod and a telescopic rod; one end of the telescopic rod stretches into the main rod and can slide along the length direction of the main rod, and the main rod is provided with a locking member for stopping the sliding of the telescopic rod.

In one embodiment, the top of the telescopic rod is provided with a helical rack, and the locking member is provided with clamping teeth matched with the helical rack.

In one embodiment, two helical racks are symmetrically arranged as a set, respectively along the left and right length direction of the telescopic rod, and an avoidance groove is formed between the two helical racks.

In a preferred embodiment, the locking member is inserted into the top wall of the main rod along the end of the main rod and fixed by a fastener, and the bottom of the locking member is bent to form a hook for clamping with the top wall of the main rod.

In a preferred embodiment, a limiting rib is arranged on the top wall of the main rod along the length direction of the main rod, and a limiting groove matched with the limiting rib is provided on the locking member.

In a preferred embodiment, the clamping teeth are arranged at the bottom of the locking member, and the bottom of the locking member, which close to the clamping teeth, extends obliquely upward to form a switch part.

In a preferred embodiment, the telescopic rod is provided with a connecting end surface at one end away from the main rod.

Compared with the prior art, the invention has the advantages that in the present invention, through the cooperation of the telescopic rod and the main rod, the entire mounting rod assembly can be fitted to the window frames of various sizes during installation. The installation length is adjusted by adjusting the length of the telescopic rod extending out of the main rod, and then locking and positioning the telescopic rod with the locking member, which makes the curtain more applicable and the installation more flexible.

As shown in the figures, 1 main rod, 2 telescopic rod, 3 locking member, 4 helical rack, 5 clamping teeth, 6 avoidance groove, 7 hook, 8 limiting rib, 9 limiting groove, 10 switch part, 11 connecting end surface, 12 mounting hole, 13 mounting space.

EMBODIMENTS

Embodiments will be readily understood by the following detailed description in conjunction with the accompanying drawings.

Figure 1:
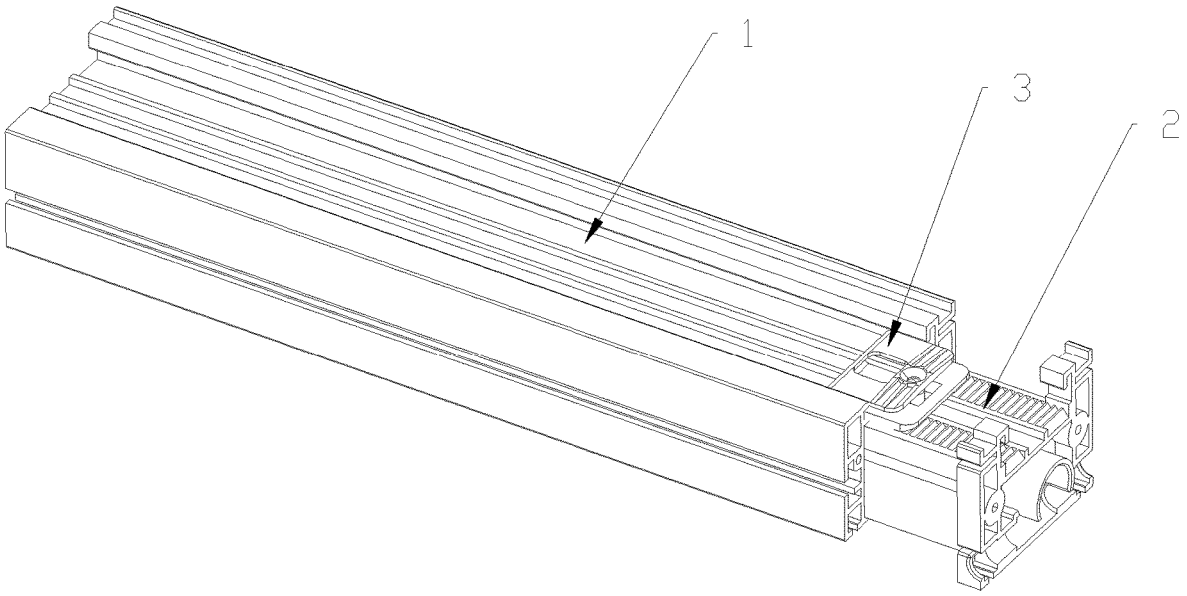
FIG. 1 is a structural schematic diagram of the present invention.
Figure 2:
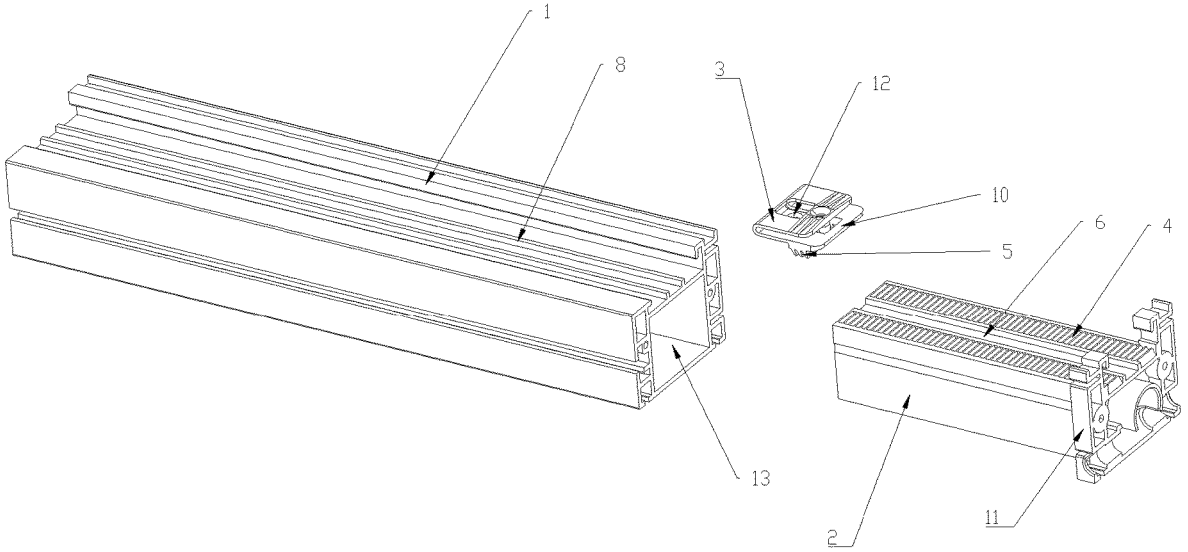
FIG. 2 is an exploded view of the present invention.
Figure 3:
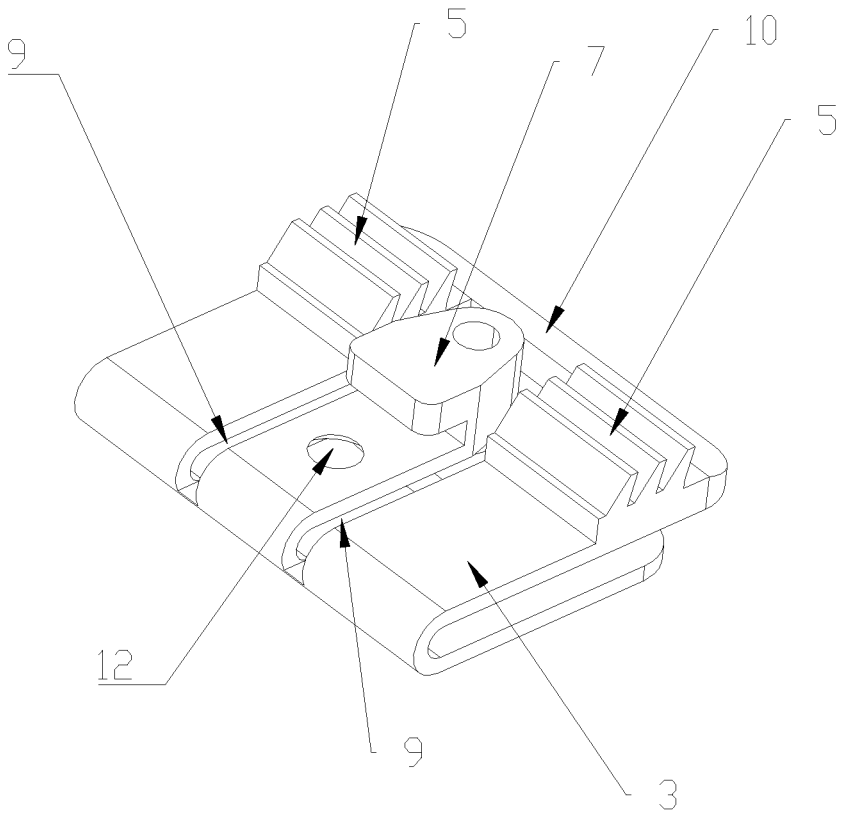
FIG. 3 is a structural schematic diagram of the locking member according to the present invention.

As shown in FIGS. 1-3, a mounting rod assembly for installing a curtain comprises a main rod 1 and a telescopic rod 2; the main rod 1 comprises a top wall, a bottom wall and two side walls which are all integrally formed; a mounting space 13 is arranged between the top wall, the bottom wall and the two side walls; one end of the telescopic rod 2 stretches into the main rod 1 and can slide along the length direction of the main rod 1; the shape of the telescopic rod 2 is matched with the shape of the mounting space 13, and the main rod 1 is provided with a locking member 3 for stopping the sliding of the telescopic rod 2; the locking member 3 is inserted into the top wall of the main rod 1 along the end of the main rod 1 and fixed by a fastener, and the locking member 3 is provided with a mounting hole 12 for screwing the fastener; the bottom of the locking member 3 is bent to form a hook 7 for clamping with the top wall of the main rod 1; the end of the main rod 1 along which the locking member 3 is inserted into is the entrance for the telescopic rod 2 to stretch into the mounting space 13; the arrangement of the hook 7 together with the fastener, the locking member 3 is firmly fixed on the main rod 1, and the telescopic rod 2 is effectively locked; the telescopic rod 2 is prevented from free expansion and contraction; a limiting rib 8 is arranged on the top wall of the main rod 1 along the length direction of the main rod 1, and a limiting groove 9 matched with the limiting rib 8 is provided on the locking member 3; since the limiting groove 9 is matched with the limiting rib 8, the locking member 3 can be conveniently pre-positioned when the locking member 3 is connected with the main rod 1, meanwhile, the locking member 3 is also prevented from moving left and right to improve the installation effect; preferably, there are two limiting ribs 8 and the number of the limiting grooves 9 is the same as that of the limiting ribs 8; the top of the telescopic rod 2 is provided with a helical rack 4; the locking member 3 is provided with a clamping teeth 5 matched with the helical rack 4; when the telescopic rod 2 is pulled out of the mounting space 13 of the main rod 1 under the action of external force, the clamping teeth 5 do not play a locking role, and the telescopic rod 2 can be pulled out easily; when the telescopic rod 2 is pushed to the mounting space 13 of the main rod 1 under the action of external force, the clamping teeth 5 play a reverse locking role, and the telescopic rod 2 cannot be reversely retracted into the mounting space 13; the spacing between each of the helical teeth on the helical rack 4 is equal; besides the locking function, the cooperation of the clamping teeth 5 and the helical rack 4 makes it easier to adjust the telescopic length of the telescopic rod 2 as well; each time the telescopic rod 2 moves a helical tooth position, the telescopic length is equal, realizing a precise adjustment of the telescopic length and a better controllability; preferably, two helical racks 4 are symmetrically arranged as a set, respectively along the left and right length direction of the telescopic rod 2, and the number of the clamping teeth 5 on the locking member 3 is matched with the number of the helical rack 4; the clamping teeth 5 and the helical rack 4 are symmetrically arranged on the locking member 3; with two sets of clamping teeth 5 matched with helical racks 4, the telescoping of the telescopic rod 2 is more stable, and the locking more reliable; an avoidance groove 6 is formed between the two helical racks 4, and the avoidance groove 6 is used for avoiding the hook 7 on the locking member 3; the clamping teeth 5 are arranged at the bottom of the locking member 3, and the bottom of the locking member 3, which close to the clamping teeth 5, extends obliquely upward to form a switch part 10; the setting of the switch part 10 provides great convenience for people to manually unlock the clamping teeth 5 to reversely lock the telescopic rod 2; when the length of the telescopic rod 2 extending out of the main rod 1 is too long, reverse contraction is required; one can lift the switch part 10 upward, and the bottom of the locking member 3 is elastically deformed; the clamping teeth 5 are separated from the helical rack 4 to unlock the telescopic rod 2, and the telescopic rod 2 is reversely retracted into the main rod 1, thus the overall length is shortened; in addition, the two limiting grooves 9 on the locking member 3 are communicated with each other at the end near the clamping teeth, and the bottom of the hook 7 is separated from the bottom provided with the clamping teeth 5; when the switch part 10 is lifted by people, only the bottom provided with the clamping teeth 5 is pulled to deform, so that the clamping teeth 5 unlock the helical rack 4 without pulling the bottom of the hook 7 to deform, therefore the clamping connection between the hook 7 and the top wall of the main rod 1 is avoided; the telescopic rod 2 is provided with a connecting end surface 11 at one end away from the main rod 1; the connecting end face 11 is used for connecting the accessories for installing a curtain, and the accessory can be a punching-free mounting assembly, a connector for connecting a curtain main body or the like.

In the present invention, through the cooperation of the telescopic rod 2 and the main rod 1, the entire mounting rod assembly can be fitted to the window frames of various sizes during installation. The installation length is adjusted by adjusting the length of the telescopic rod 2 extending out of the main rod 1, and then locking and positioning the telescopic rod 2 with the locking member 3, which makes the curtain more applicable and the installation more flexible. When the overall length of the mounting rod assembly needs to be increased, simply pull the telescopic rod 2 outward, and after the external force is removed, the overall length of the mounting rod assembly is fixed; when the overall length of the mounting rod assembly needs to be shortened, firstly, lift the switch part 10 on the locking member 3 up so that the clamping teeth 5 disengage from the helical rack 4 to unlock the telescopic rod 2, then push the telescopic rod 2 inward so that the telescopic rod 2 is retracted to the main rod 1; after the external force is removed, the clamping teeth 5 are meshed with the helical rack 4 to lock the telescopic rod 2 from stretching, and the overall length of the mounting rod assembly is fixed.

Although certain embodiments have been illustrated and described herein for purposes of description, a wide variety of alternate and/or equivalent embodiments or implementations calculated to achieve the same purposes may be substitute for the embodiments shown and described without departing from the scope of the present disclosure. This application is intended to cover any adaptations or variations of the embodiments discussed herein. Therefore, it is manifestly intended that embodiments described herein be limited only by the claim and the equivalents thereof.

We claim:

1. A mounting rod assembly for installing a curtain, comprises a main rod (1) and a telescopic rod (2); one end of the telescopic rod (2) stretches into the main rod (1) and can slide along the length direction of the main rod (1), and the main rod (1) is provided with a locking member (3) for stopping the sliding of the telescopic rod (2);

wherein the top of the telescopic rod (2) is provided with a helical rack (4) and the locking member (3) is provided with clamping teeth (5) matched with the helical rack (4);

wherein the locking member (3) is inserted into the top wall of the main rod (1) along the end of the main rod (1), and fixed by a fastener, and the bottom of the locking member (3) is bent to form a hook (7) for clamping with the top wall of the main rod (1).

2. The mounting rod assembly for installing a curtain of claim 1, wherein two helical racks (4) are symmetrically arranged as a set, respectively along the left and right length direction of the telescopic rod (2), and an avoidance groove (6) is formed between the two helical racks (4).

3. The mounting rod assembly for installing a curtain of claim 1, wherein a limiting rib (8) is arranged on the top wall of the main rod (1) along the length direction of the main rod (1), and a limiting groove (9) matched with the limiting rib (8) is provided on the locking member (3).

4. The mounting rod assembly for installing a curtain of claim 1, wherein the clamping teeth (5) are arranged at the bottom of the locking member (3), and the bottom of the locking member (3), which is close to the clamping teeth (5), extends obliquely upward to form a switch part (10).

5. The mounting rod assembly for installing a curtain of claim 1, wherein the telescopic rod (2) is provided with a connecting end surface (11) at one end away from the main rod (1).

* * * * *